US010058175B2

(12) United States Patent
Dubach

(10) Patent No.: US 10,058,175 B2
(45) Date of Patent: Aug. 28, 2018

(54) DRIVE DEVICE FOR A MOVABLE FURNITURE PART

(71) Applicant: Julius Blum GmbH, Hoechst (AT)

(72) Inventor: Fredi Dubach, Baertwil (CH)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 15/171,301

(22) Filed: Jun. 2, 2016

(65) Prior Publication Data

US 2016/0270533 A1 Sep. 22, 2016

Related U.S. Application Data

(63) Continuation of application No. PCT/AT2014/000186, filed on Oct. 17, 2014.

(30) Foreign Application Priority Data

Dec. 3, 2013 (AT) ..... A 926/2013

(51) Int. Cl.
*A47B 88/00* (2017.01)
*A47B 88/04* (2006.01)
(Continued)

(52) U.S. Cl.
CPC ..... *A47B 88/0481* (2013.01); *A47B 88/47* (2017.01); *A47B 88/483* (2017.01);
(Continued)

(58) Field of Classification Search
CPC ..... A47B 88/463; A47B 88/47; A47B 88/57; A47B 88/0477; A47B 88/467;
(Continued)

(56) References Cited

U.S. PATENT DOCUMENTS 8,109,582 B2 2/2012 Dubach
8,511,763 B2 * 8/2013 Salice ..... A47B 88/47 312/319.1

(Continued)

FOREIGN PATENT DOCUMENTS

DE 20 2009 004 955 12/2010
DE 10 2010 036 902 2/2011

(Continued)

OTHER PUBLICATIONS

International Search Report dated Jan. 30, 2015 in International (PCT) Application No. PCT/AT2014/000186.

(Continued)

*Primary Examiner* — Janet M Wilkens
(74) *Attorney, Agent, or Firm* — Wenderoth, Lind & Ponack, L.L.P.

(57) ABSTRACT

A driving device for a movable furniture part includes a retracting device for retracting the movable furniture part out of an open position into a close position, and the retracting device has a housing; a guide path formed in the housing and which comprises a retaining section; a retracting slide which can be moved in the guide path relative to the housing and can be locked in the retaining section; and a retracting force accumulator which urges the retracting slide. The retracting slide can be moved along the guide path between a first end position, which corresponds to the retaining section, and a second end position, which corresponds to the closed position, wherein the distance between the end positions along the guide path can be changed.

16 Claims, 15 Drawing Sheets

(51) Int. Cl.
*A47B 88/47* (2017.01)
*A47B 88/483* (2017.01)
*A47B 88/57* (2017.01)

(52) U.S. Cl.
CPC ..... *A47B 88/57* (2017.01); *A47B 2210/0016* (2013.01); *A47B 2210/0091* (2013.01)

(58) Field of Classification Search
CPC ..... A47B 88/0481; A47B 88/12; A47B 88/16; A47B 2210/0016; A47B 2210/0091
USPC ..... 384/21; 312/333, 334.7, 330.1, 319.1, 312/334.4
See application file for complete search history.

(56) References Cited

U.S. PATENT DOCUMENTS 8,807,671 B2 * 8/2014 Brunnmayr ..... A47B 88/0477 312/319.1
8,905,497 B2 * 12/2014 Bantle ..... A47B 88/0477 267/150
9,215,929 B2 * 12/2015 Brunnmayr ..... A47B 88/0481
9,277,815 B2 3/2016 Brummayr
2004/0237252 A1 * 12/2004 Hoshide ..... E05F 1/16 16/72
2006/0238089 A1 * 10/2006 Prentner ..... E05F 1/16 312/333
2008/0191592 A1 8/2008 Dubach
2012/0272478 A1 * 11/2012 Bantle ..... A47B 88/0477 16/296
2013/0076219 A1 * 3/2013 Lam ..... A47B 88/14 312/319.1
2013/0088132 A1 * 4/2013 Hammerle ..... A47B 88/047 312/319.1
2013/0134852 A1 * 5/2013 Salice ..... A47B 88/47 312/319.1
2014/0021841 A1 * 1/2014 Brunnmayr ..... A47B 88/0477 312/319.1
2014/0346941 A1 11/2014 Gasser et al.
2015/0374125 A1 * 12/2015 Goetz ..... A47B 88/0477 312/319.1
2016/0007749 A1 1/2016 Brummayr
2016/0135595 A1 * 5/2016 Erdel ..... A47B 88/931 312/333

FOREIGN PATENT DOCUMENTS

DE 10 2010 036 903 9/2011
DE 10 2011 051 907 1/2013
WO 2005/044046 5/2005
WO 2007/028177 3/2007
WO 2011/015663 2/2011
WO 2012/084593 6/2012
WO 2013/120119 8/2013
WO 2014/082106 6/2014
WO 2014/165876 10/2014

OTHER PUBLICATIONS

Austrian Search Report dated Sep. 23, 2014 in Austrian Application No. 926/2013, with English translation.
English translation of Search Report dated May 2, 2017 in Chinese Application No. 201480073132.5.

* cited by examiner

S1 + B

S1+L

S1 + B

S2 + L

DRIVE DEVICE FOR A MOVABLE FURNITURE PART

BACKGROUND OF THE INVENTION

The invention concerns a drive device for a movable furniture part, comprising a retracting device for retracting the movable furniture part from an open position into a closed position. The retracting device has a housing, a guide path which is formed in the housing and which comprises a retaining section, a retracting slide which can be moved in the guide path relative to the housing and can be locked in the retaining section, and a retracting force storage member which urges the retracting slide. The retracting slide can be moved along the guide path between a first end position, which corresponds to the retaining section, and a second end position, which corresponds to the closed end position. The invention further concerns an item of furniture with such a drive device.

For many years in the field of furniture fittings, there have been mechanical drive devices to move furniture parts like, for example, drawers. By pushing or by pulling on the movable furniture part, the ejection movement is mechanically supported or taken over completely. Also, the closing movement can be effected by a so-called retracting device, so that the drawer does not have to be pushed manually until the closed position but especially the last movement section of the closing movement is taken over.

For many years, there have been efforts to combine these actually contrary movements of retracting and ejecting. It has been especially important to ensure that the contrarily acting forces do not hinder each other. One possibility for that objective is to provide an appropriate arrangement of the tensioning paths of the individual force storage member. It is also possible to realize correspondingly different spring forces of the individual force storage member. A further possibility exists therein to make the spring forces adjustable. Thus, already now miscellaneous configuration can be set with these variants.

SUMMARY OF THE INVENTION

The object of the present invention is now to establish an alternative or better drive device compared to the prior art.

According to an embodiment of the present invention, this object is achieved by allowing that the distance of the end positions from each other along the guide path can be changed. In other words, the travel of the retracting slide is changed. This makes it possible to individually adapt the retracting path to the circumstances. Thus, for example, a short retracting path is already sufficient when there is a relatively small drawer. Alternatively, however, drawers can be stopped because of their weight and because of friction before reaching the retracting path when manually closing. This undesirable stopping at a half opened drawer can be prevented by an elongation of the retracting path (distance between the end positions form each other).

Basically, it is possible that the distance of the end positions is adjustable by removable limit stops or by bordering elements. Preferably, however, the housing can have a base part and a slide part which is movable relative to the base part between at least a first state and a second state. Depending on the state of the slide part, the distance between the end positions is also different.

According to a further preferred embodiment, the distance between the first end position and the second end position of the retracting slide along the guide path can be made larger in the first state than in the second state. Concretely, the travel in the guide path is thus enlarged by the movement of the slide part into the second state.

In principle, the slide part can form a limit stop for the retracting slide which is formed separately from the guide path. Preferably, however, at least a part of the guide path is formed in the slide part. Preferably, the whole guide path is formed in the slide part of the housing of the retracting device.

In order to enable a setting of the positions of the slide part as easy as possible, it is preferable that the slide part be set in a blocking position by a blocking device, the blocking position corresponding to the first state. Correspondingly, the blocking position of the blocking device can be unset, whereby the slide part can be moved from the first state into the second state. The blocking device itself can work as a separate component between slide part and base part. Preferably, the blocking device comprises a, preferably elastically, movable latch, which is formed on the slide part, and a stop for the latch, the stop being formed on the base part.

As already mentioned in the introduction, not only retracting devices are provided in modern drive devices for movable furniture parts. In addition, according to a preferred embodiment, the drive device can also have an ejection device for ejecting the movable furniture part out of the closed position into an open position. This ejection device can be partly integrated in the retracting device, so that the retracting device and the ejection device form a construction unit for mounting on the furniture item or on the movable furniture part.

In order to ensure a better flexibility, however, it is desired that the retracting device and the ejection device are produced as separate construction units which can be individually offered and sold. With such a configuration, it is important that the individual construction units can completely function on their own and can also be mounted as easy as possible.

If now, however, both construction units are mounted in one and the same item of furniture or movable furniture part, it is important that the individual functions do not hinder each other. This is particularly important when an ejection device is retrofitted to an existing retracting device. Until now, the retracting device has had to be exchanged when retrofitting the ejection device in order to be able to use the individual functions without limit because when using an ejection device the retraction device can only retract along a shorter retracting path.

Now in order to prevent the exchange of the already mounted retracting device, from the outset a retracting device according to the invention with a changeable retracting path is mounted. Thus, this retracting device can be optionally retrofitted with an ejection device. When retrofitting, the retracting path can be changed, more particularly can be shortened, whereby a smooth operation of the tensioning movements and of the ejection and retracting movements respectively is guaranteed.

This means that, when only the retracting device is mounted, another—in the particular case a longer—travel for the retracting device is provided. If now also the ejection device is mounted, the travel of the retracting slide has to be changed—in particular shortened. With a drive device according to the invention, this change is possible in an easy manner without exchanging the whole retracting device.

For example, the distance of the end positions to each other can be easily changed prior to the mounting of the ejection device by a technician, for example by manually shifting of the slide part. Particularly preferable, however, the ejection device can be connected with the retracting device, and the distance of the end positions from each other along the guide path can be changed by the connecting of the ejection device with the retracting device. This means, when an ejection device is retrofitted or also mounted synchronically, the travel of the retracting slide is automatically changed by the mounting of the ejection device. This change or adjustment can be effected, for example, by an electric control. Preferably, however, it this change is effected only in a mechanical manner, for example, in that the blocking position of the blocking device can be unset by the ejection device. In the particular case, the ejection device can include a triggering element by which the blocking device is movable from the blocking position, in which the latch abuts the stop, into a release position, in which the latch is released from the stop by the triggering element, when connecting the ejection device with the retracting device. The mounting movement can thus be used to change the corresponding state of the end positions.

The ejection device can, for example, be mounted on the underside of the drawer bottom. For an easy mounting, the ejection device can preferably be positive-locked or fixed to the retracting device by a fixing device. Moreover, guiding elements for the ejection device can preferably be formed on the retracting device, and the ejection device can be fixed at the retracting device by the fixing device by a sliding movement which is guided by the guiding element. Particularly preferably, this sliding movement can be used not only to reach a connection or fixation of the ejection device to the retracting device, but also to effect the change of the distance of the end positions to each other. This can be particular effected in that the slide part of the retracting device is movable from the first state to the second state during the slide movement of the ejection device.

An item of furniture can include a drive device according to the invention.

BRIEF DESCRIPTION OF THE DRAWINGS

Further details and advantages of the present invention are described more fully hereinafter by means of the specific description with reference to the embodiments illustrated in the drawings, in which.

DETAILED DESCRIPTION OF THE INVENTION

Figure 1:
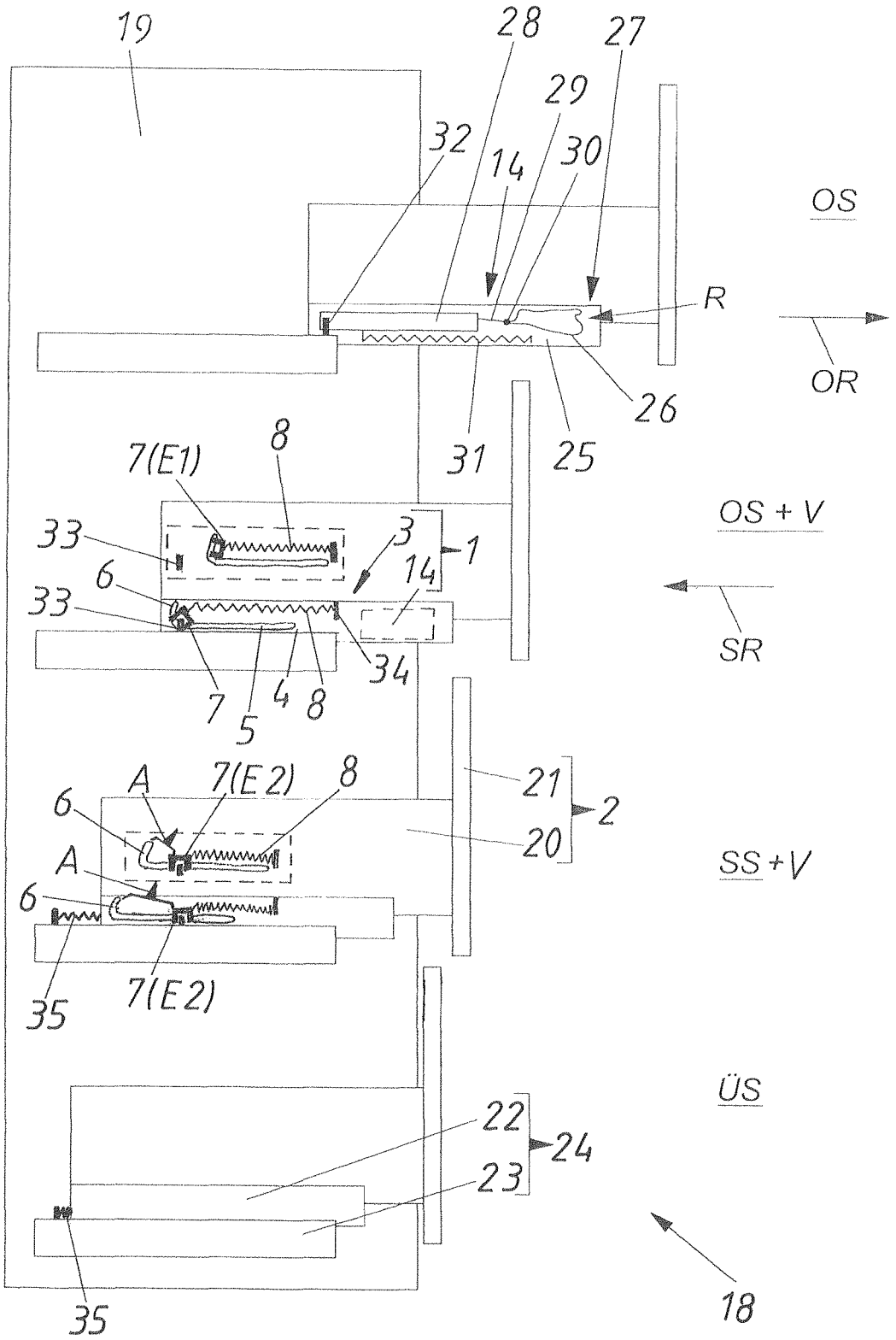
FIG. 1 schematically shows an article of furniture with movable furniture parts in different positions, FIG. 2 schematically shows the progress of the spring forces of the retracting force storage member and of the ejection force storage member at an opening and closing movement.

FIG. 1 shows an item of furniture 18 with a furniture carcass 19 and in total four movable furniture parts 2 in the form of drawers. Seen from top to bottom, both upper drawers are in an open position OS, the third drawer is in the closed position SS, and the lowest drawer is in the over-pressing position US. The movable furniture parts 2 each comprise the drawer container 20 and the front panels 21. The movable furniture part 2 is connected to extension guide 24 via the drawer container 20. This extension guide comprises the drawer rail 22, a center rail 36 (which is not shown here), and the carcass rail 23. At the drawer shown topmost, an ejection device 14 is drawn schematically. This ejection device 14 is mounted to the drawer rail 22 (or to the drawer bottom) via the housing 25. The ejection entrainment member 32—which can be coupled at least section-wise with the ejection slide 28 of the ejection device 14—is fixed to the carcass rail 23. This ejection slide 28 is movable relative to the housing 25.

The control lever 29 is pivotably mounted to the ejection slide 28, and the control pin 30 is formed on this control lever 29. This control pin 30 is guided in the heart curve shaped sliding guide path 26. This sliding guide path 26 comprises the latch recess R for the control pin 30. The control pin 30 together with the latch recess R of the sliding guide path 26 forms the locking device 27 for the ejection slide 28 at the housing 25.

The ejection slide 28 is urged by the ejection force storage member 31 (in this case a compression spring). In the shown illustration according to the topmost drawer, this ejection force storage member 31 is relaxed. By this ejection device 14, the movable furniture part 2 is—as per se known—ejected from a closed position SS into opening direction OR. This is effected, starting from the topmost shown drawer, as described below.

By pressing onto the movable furniture part 2 in the closing direction SR, the movable furniture part 2 arrives in the open position OS according to the second drawer. During this movement, the retracting slide 29 is shifted by the ejection entrainment member 32 relative to the housing 25, whereby the ejection force storage member 31 is loaded and the control pin 30 arrives in the latch recess R. In this way, the locking device 27 is in the locking position V. Then, starting from this position, the movable furniture part 2 is retracted into the closing position SS by the retracting device 3. This movement operation is explained later in still more detail. In this way, the drawer arrives in the closing position SS according to the third drawer, and the ejection device 14 is still in the locking position V. By over-pressing the movable furniture part 2 from this closing position SS, the movable furniture part arrives in the over-pressing position US according to the lowest drawer. Thereby, the buffer 35—which defines the exact position of the closed position SS—arranged between the drawer rail 22 and the carcass rail 23 is also pushed in. By this over-pressing movement, the locking position V is released and the control pin 30 arrives in an ejection section of the heart curve shaped sliding guide path 26, and the ejection force storage member 31 is relaxed and the movable furniture part 2 is ejected in the opening direction OR. In this case, the ejection device 14 is associated with the movable furniture part 2. Of course, however, this can also be effected in a contrary manner, in which the ejection device 14 is associated with the furniture carcass 19 or the carcass rail 24 and acts on an ejection entrainment member 32 which is associated with the movable furniture part 2. Both of these arrangement possibilities of course apply analogous also for the retracting device 3.

Further details of this retracting device 3 can be told on behalf of both drawers in the middle of FIG. 1. Referring to the upper one of these drawers, the retracting device 3

(which forms the drive device 1 together with the ejection device 4) is just at the beginning of the retracting movement. The retracting device 3 comprises a housing 4, with which the retracting device 3 is mounted to the drawer rail 22. Moreover, the retracting device 3 comprises a retracting slide 7 guided in the guiding path 5. The retracting force storage member 8 (tension spring) is spanned between the retracting slide 7 and the spring base 34 arranged on the housing 4. The retaining section 6 for the retracting slide 7 is located at an end of the guiding path 5. Because of the movement of the movable furniture part 2 is in the closing direction SR, the retracting slide 7 was already released from the retaining section 6 by the retracting entrainment member 33 mounted on the carcass rail 24, whereby the retracting force storage member 8 can relax. Thereby the movable furniture part 2 arrives in the closed position SS according to the lower drawer. This retracting movement is stopped by the buffer 35. To this extent, the functionality of the present invention is similar to hitherto known drive devices 1 with an ejection device 14 and with a retracting device 3.

According to the invention there is now, however, also an adjusting possibility for the travel of the retracting slide 7 in the guide path 5 of the retracting device 3. Thereto, an alternative position of the guide path 5 relative to the drawer rails 22 is illustrated with both middle drawers—each emphasized by a dashed bordering. This different position or state is enabled by a slide part 10 which is not illustrated in more detail here. As shown at the upper drawer, the retracting entrainment member 33—which is located at the same position when there is the same open position OS of the movable furniture part 2—does not yet abut the retracting slide 7. Much more, the retracting slide 7 is still in the retaining section 6 of the guide path 5. This retaining section 6 corresponds to the first end position E1 of the retracting slide 7 in the guide path 5. As can be seen, in this case the retracting force storage member 8 is not loaded this strong as in the other case. This, however, does not hinder the retracting movement. Much more, the retracting movement is just started with a lower, but thereby also smoother, force. If now the movable furniture part 2 is manually moved further in the closing direction SR, the retracting entrainment member 33 contacts the retracting slide 7, whereby the retracting slide 7 is released from the retaining section 6 of the guide path 5. The retracting force storage member 8 can thereby relax and the retracting device 3 pulls the movable furniture part 2 into the closed position SS. This closed position SS corresponds to the second end position E2 of the retracting slide 7 along the guide path 5. As shown with the lower drawer, the distance A of the end positions E1 and E2 to each other is therefore different depending on the state of the guide path 5. This means, the length of the travel of the retracting slide 7 along the guide path 5 is different.

Figure 2:
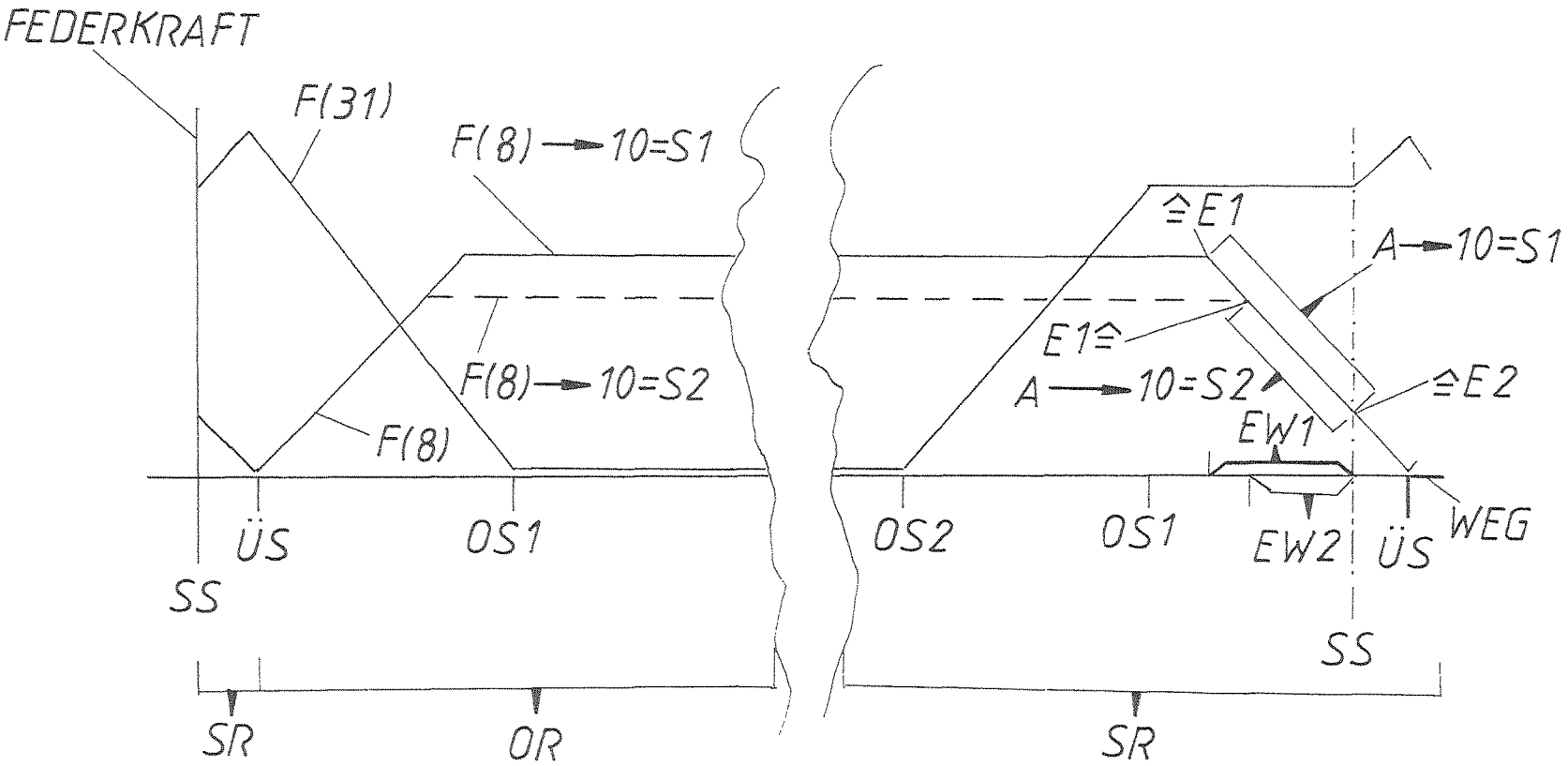

In FIG. 2 the progress of the spring forces of the force storage member 8 and 31 along the movement path of the movable furniture part 2 is illustrated schematically. In this case, the spring forces are illustrated as straight lines, in the concrete case the spring force progress is of course more curved. In the diagram according to FIG. 2, the spring forces F(31) of the ejection force storage member 31 and F(8) of the retracting force storage member 8 are compared. The spring force of the force storage member 31 is higher than the spring force of the retracting force storage member 8. Fully left, the movable furniture part 2 is located in the closed position SS. Thereby, the ejection force storage member 31 is fully tensioned and loaded. The retracting force storage member 8 is relaxed. By moving the movable furniture part 2 in the closing direction SR, the movable furniture part 2 reaches the over-pressing position OS. At that position, the ejection force storage member 31 is further loaded, while the retracting force storage member 8 relaxes. By releasing the movable furniture part 2, the ejection force storage member 31 can then relax, whereby the movable furniture part 2 is ejected in opening direction OR and reaches the open position OS1. Simultaneous with this ejection movement, the retracting force storage member 8 is also tensioned. If the slide part 10 at that position is in the first state S1, the retracting force storage member 8 is tensioned to a higher spring force F(8) than if the slide part 10 is in the second state S2.

If now the movable furniture part 2, starting from a free run, is moved again into closing direction SR, the movable furniture part 2 first arrives in the open position OS2. From this position, the ejection force storage member 31 is again loaded by the manual pushing until the open position OS1 is reached. In this movement section, the spring force F(8) of the retracting force storage member 8 remains unchanged. With a further closing movement, the retracting slide 8 is then, however, released from its retaining section 6 (and this means the retracting slide 7 leaves its first end position E1). The position of this first end position E1 depends on the state S1 or S2 of the slide part 10.

If the slide part 10 is in the state S1, the subsequent retracting path EW1 is longer than if the slide part 10 is in the second state S2 (retracting path EW2). At the end of this retracting movement, the retracting slide 7 arrives in the second end position E2 which corresponds to the closed position SS of the movable furniture part 2. The distance A between the end positions E1 and E2 is therefore—depending on the state of the slide part 10—differently long.

Figure 3:
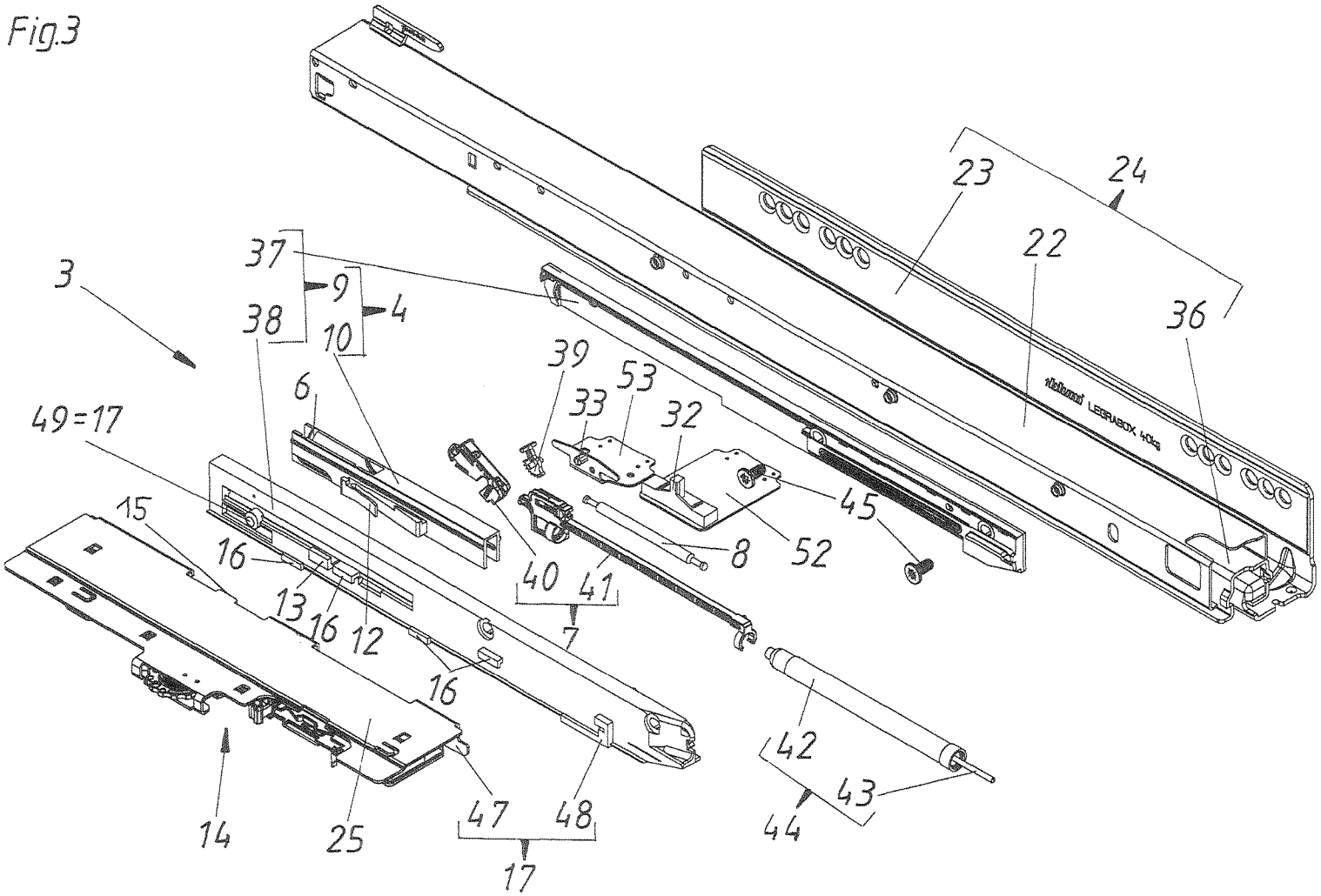
FIGS. 3 and 4 are exploded views of the retracting device with an ejection device and an extension guide.
Figure 4:
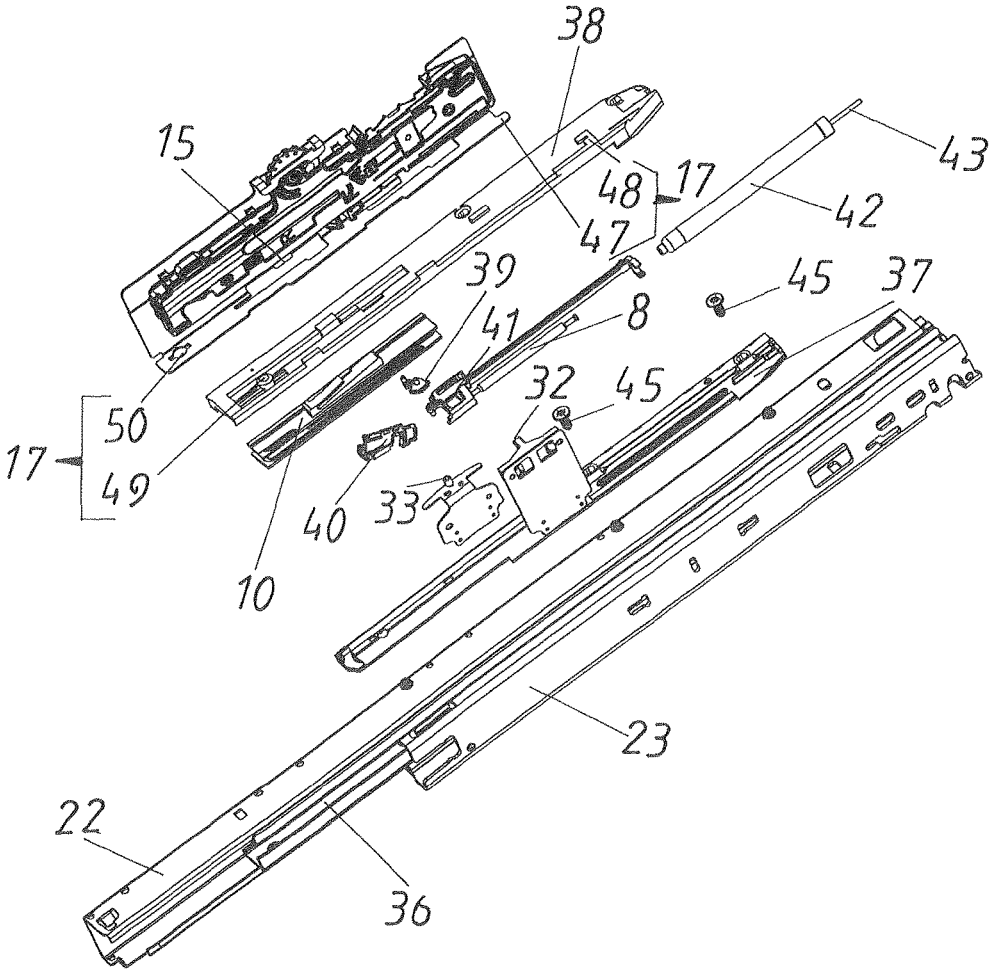

FIGS. 3 and 4 show important components of a drive device 1 in exploded views. Moreover, the extension guide 24 with the carcass rail 23, the drawer rail 22, and the central rail 36 are illustrated. As a base component, the retracting device 3 comprises a housing 4. This housing 4 consists of a base part 9 and the slide part 10 slidable relative to the base part 9. The base part 9 again consists of the base plate 37 and the base cover 38. The housing 4 is attachable to the drawer rail 22 via screws 45. In the housing 4, the retracting slide 7 is movably supported along the guide path 5. The retracting slide 7 comprises the slide base 41 and the catch lever 40 pivotably supported on the slide base 41. A dampening device 44 for damping or braking the retracting movement is arranged on the slide base 41. The dampening device 44 comprises the dampening cylinder 42 and the dampening piston 43. Further, a transmission element 39 is arranged in the area of the retracting slide 7. Moreover, the retracting force storage member 8 formed as a tensioning spring is spanned between the retracting slide 7 and the housing 4. For its function, the retracting device 3 furthermore needs the retracting entrainment member 33. This retracting entrainment member 33 is arranged on the holding plate 53 which again is mounted to the carcass rail 23.

Furthermore, the drive device 1 also comprises an ejection device 14, whose function is per se known, which is why it is not shown in an exploded view. However, details of the ejection device 14 can be found in FIG. 1. The ejection device 14 comprises a housing 25 or a mounting plate, via which the ejection device 14 can be connected with the retracting device 3. In this case, the triggering element 15 and the locking catch 47 are formed at the housing 25. Together with the locking stop 48 formed at the base cover 38, the locking catch 47 forms a part of the fixing device 17. Further, the fixing device 17 is formed by the locking projection 49 formed at the base cover 38 and by the locking recess 50 formed in the housing 25. Moreover, several guiding elements 16 for guiding the sliding movement S of the ejection device 14 at the retracting device 3 are formed at the base cover 38 of the base part 9 of the housing 4. It can also be recognized from the exploded views that the retaining section 6 of the guide path 5 is formed in the slide part 10. Furthermore, the latch 12 of the blocking device 11 is arranged on the slide part 10. The blocking device 11 is formed by the latch 12 together with the stop 13. For its function the ejection device 14 also needs the ejection entrainment member 32 which is fixed to the carcass rail 23 via the holding plate 52.

Figure 5A:
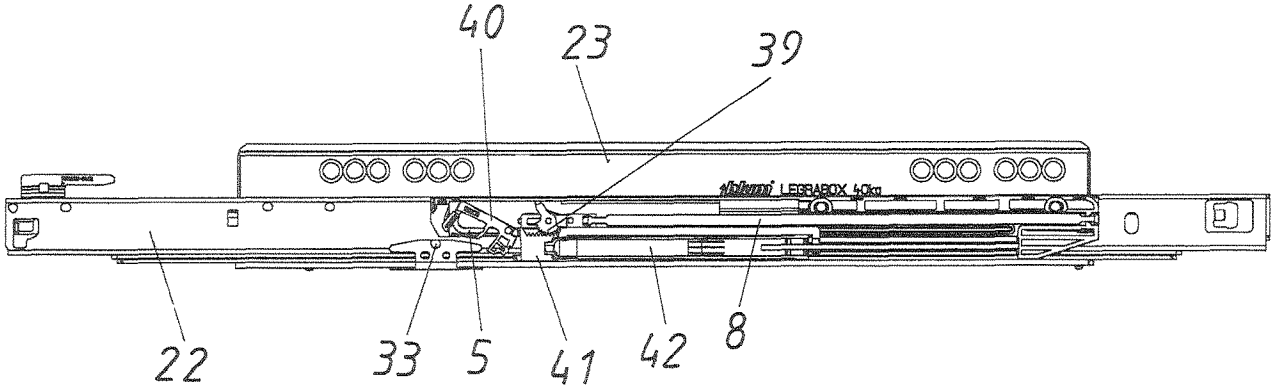
FIGS. 5A-7B show the state of the retracting device relative to the extension guide during a retracting movement.
Figure 5B:
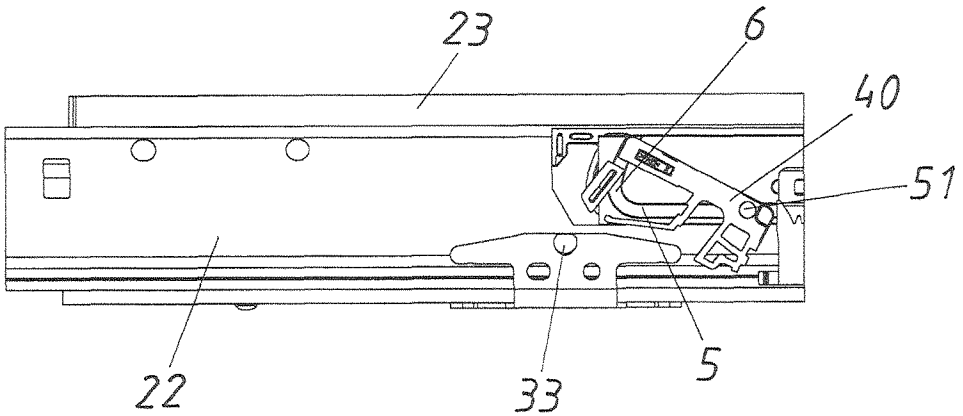

The basic retracting function is explained in more detail with respect to FIGS. 5A-7B. In FIG. 5A, the drawer rail 22 is still located in an open position OS relative to the carcass rail 23. As is shown in FIG. 5B, the catch lever 40 is still pivoted about the pivot axis 51 and is latched or held in the retaining section 6 of the guide path 5. The retracting entrainment member 33 is not yet in contact with the retracting slide 7 and with its catch lever 40, respectively.

Figure 6A:
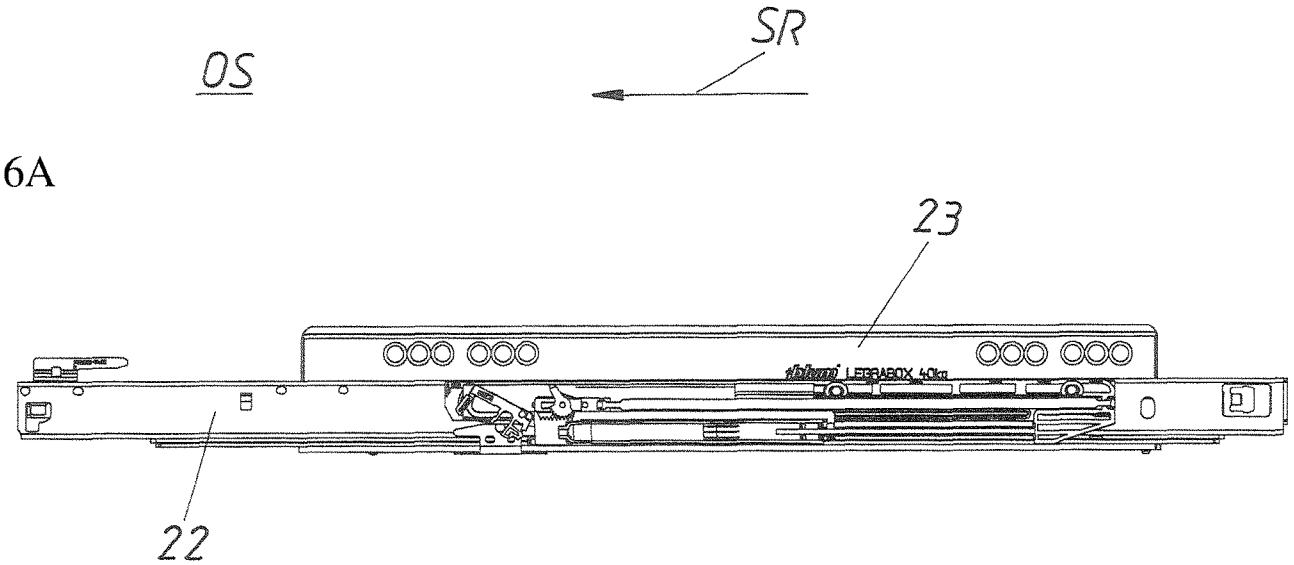
Figure 6B:
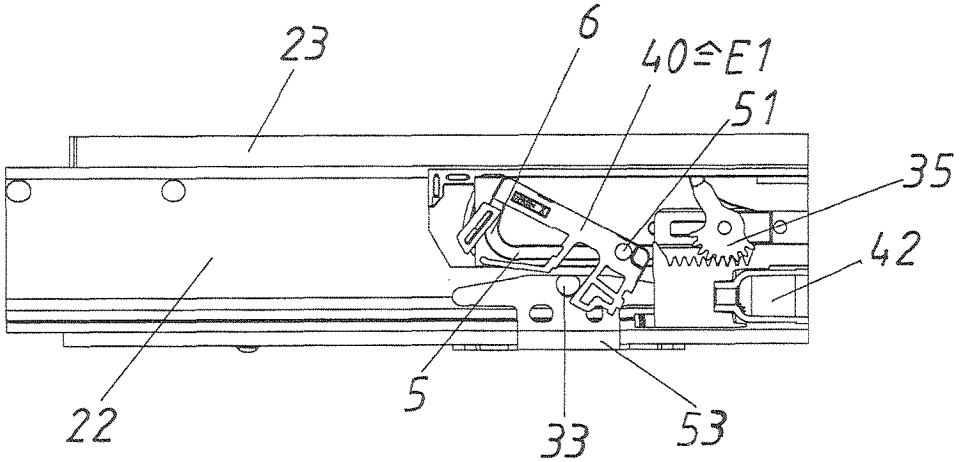

If now starting from FIG. 5A the movable furniture part 2 and the drawer rail 22 are moved in the closing direction SR, the retracting entrainment member 33 contacts the catch lever 40 as can be seen in FIGS. 6A and 6B. The catch lever 40 and thus the retracting slide 7 are still, however, in its retaining section 6, which corresponds to the first end position E1.

Figure 7A:
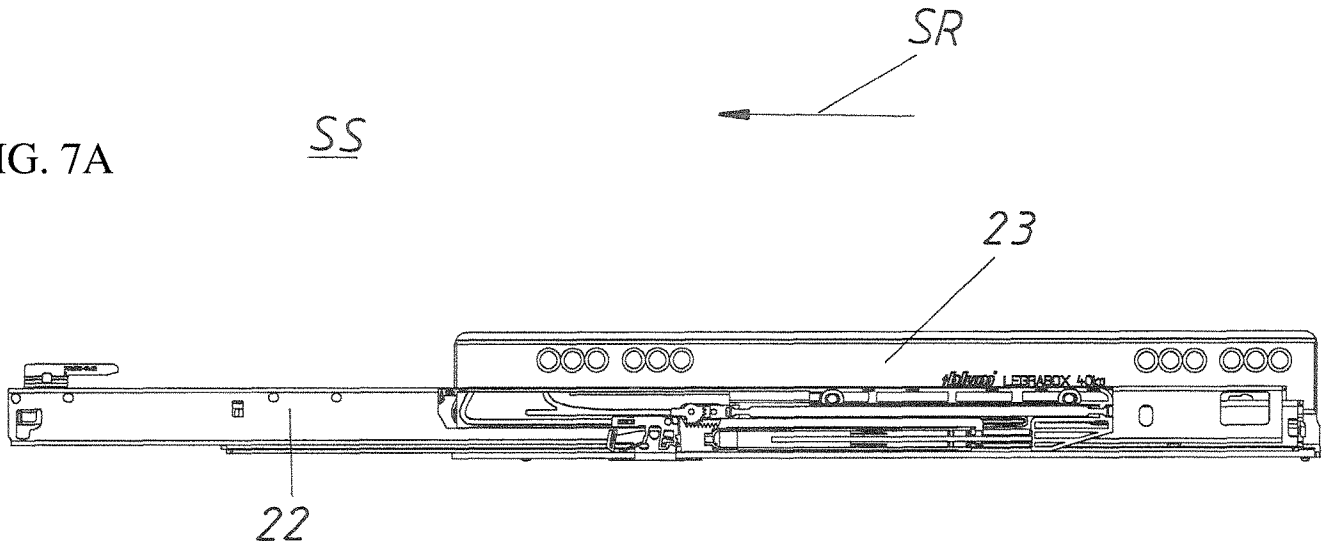
Figure 7B:
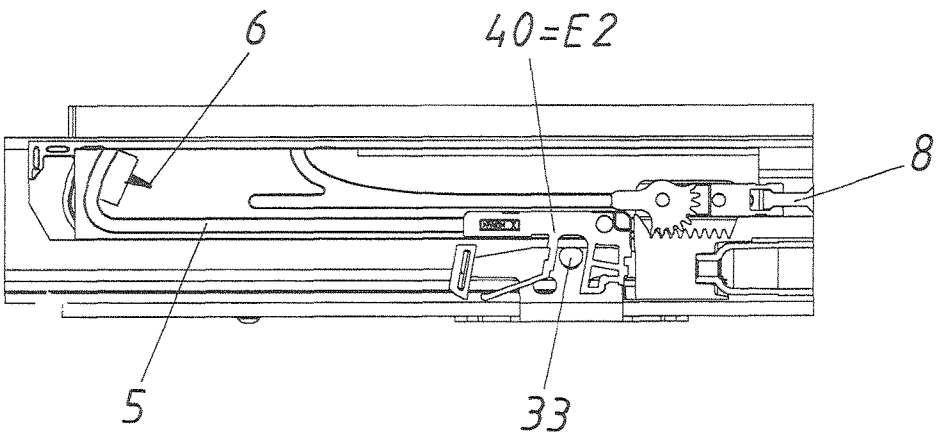

However, as soon as by the closing movement the catch lever 40 is released from the retaining section 6 because of the force effected from the retracting entrainment member 33, the retracting force storage member 8 can relax and pull the movable furniture part 2 with the drawer rail 22 into the closed position SS, as can be seen in FIGS. 7A and 7B. At that position, the catch lever 40 is also re-pivoted about the pivot axis 51 and is located in the second end position E2.

FIGS. 8A to 15 illustrate the mounting of the ejection device 14 on the retracting device 3 and as a consequence thereof the adjusting of the slide part 10 from the state S1 to the state S2 as described in more detail below.

Figure 8B:
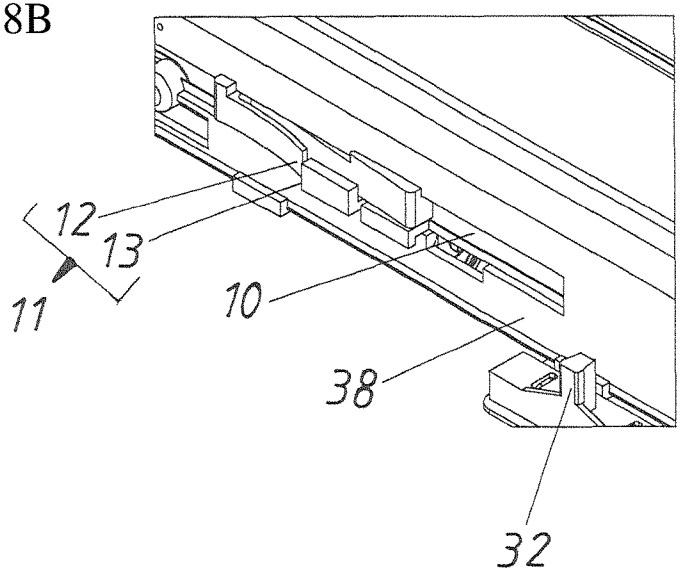
FIGS. 8-10B show the mounting progress of the ejection device on the retracting device.
Figure 8A:
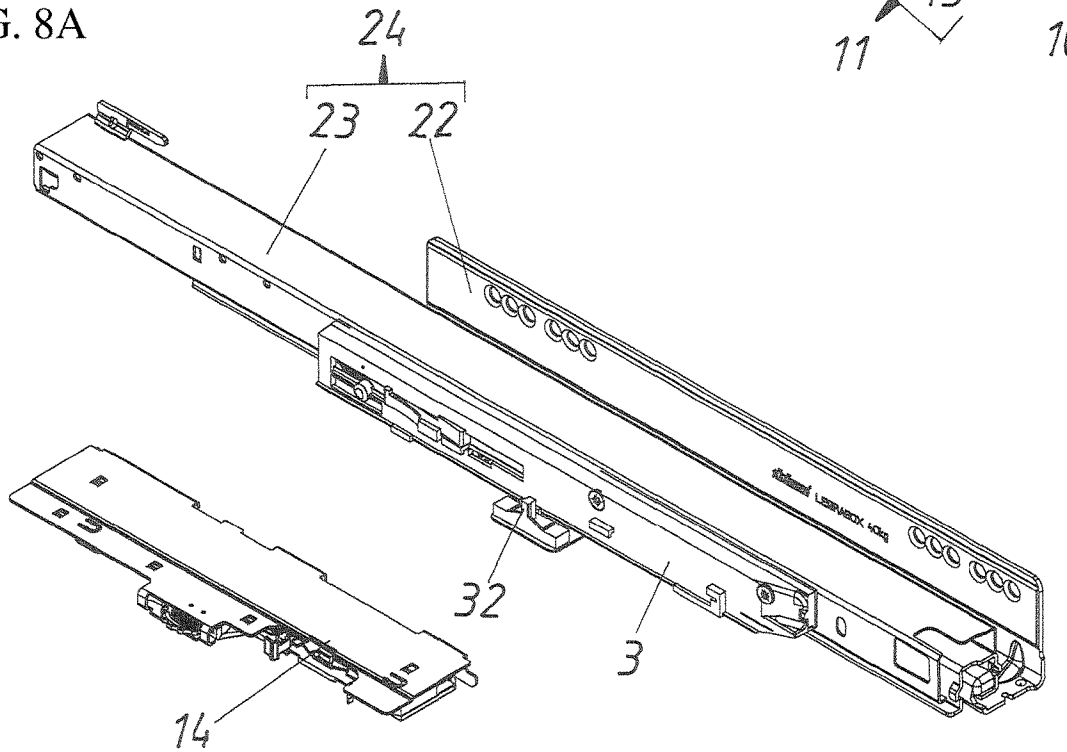

In FIG. 8A, the retracting device 3 is illustrated in a state mounted to the drawer rail 23. At that position, the slide part 10 is located in the first state S1. Therefore, the travel or the retracting path EW1 of the retracting slide 7 is long. This first state S1 of the slide part 10 is reached or fixed by the blocking device 11, because the resilient latch 12 formed on the slide part 10 abuts the stop 13 formed on the base cover 38 (see FIG. 8B).

Figure 9B:
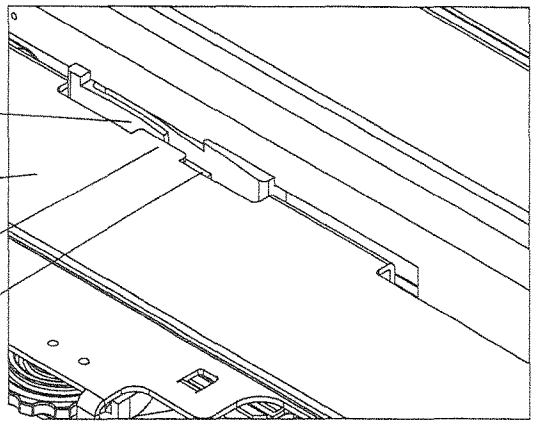
Figure 9A:
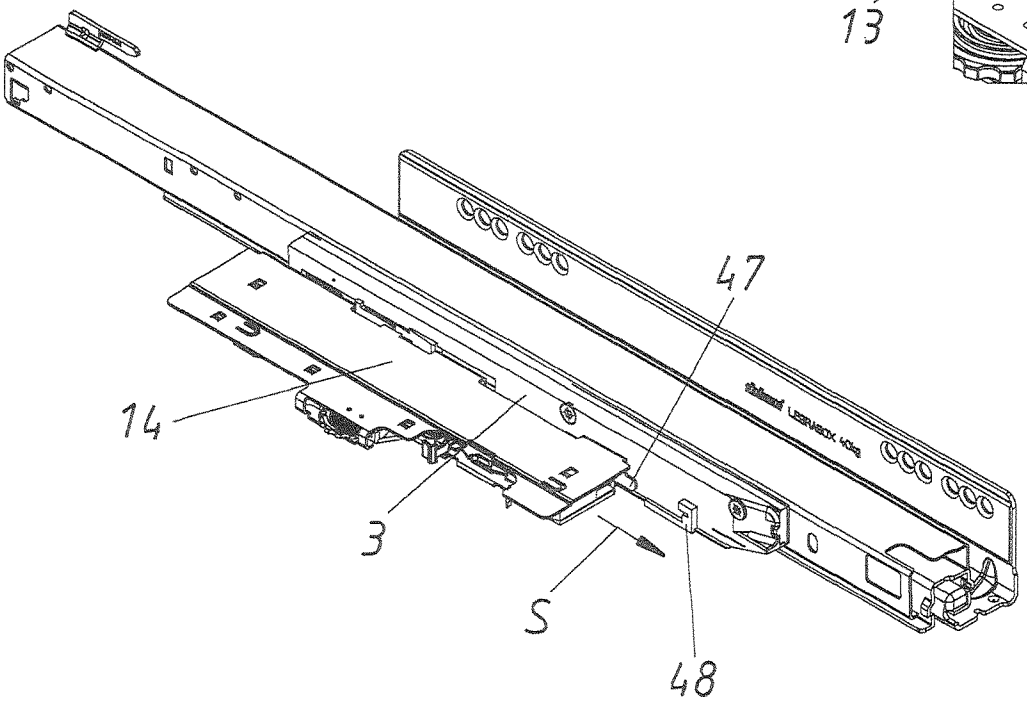
Figure 10B:
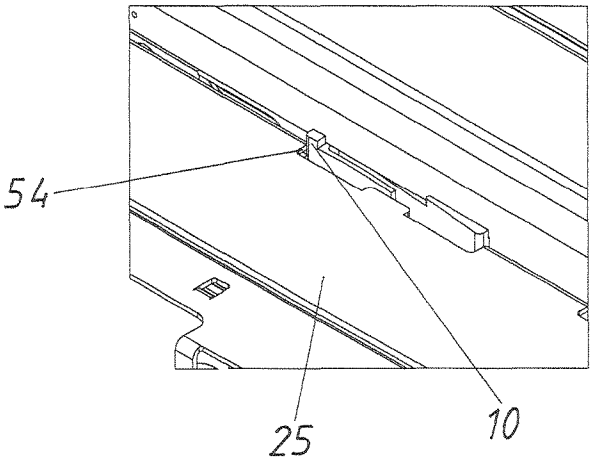
Figure 10A:
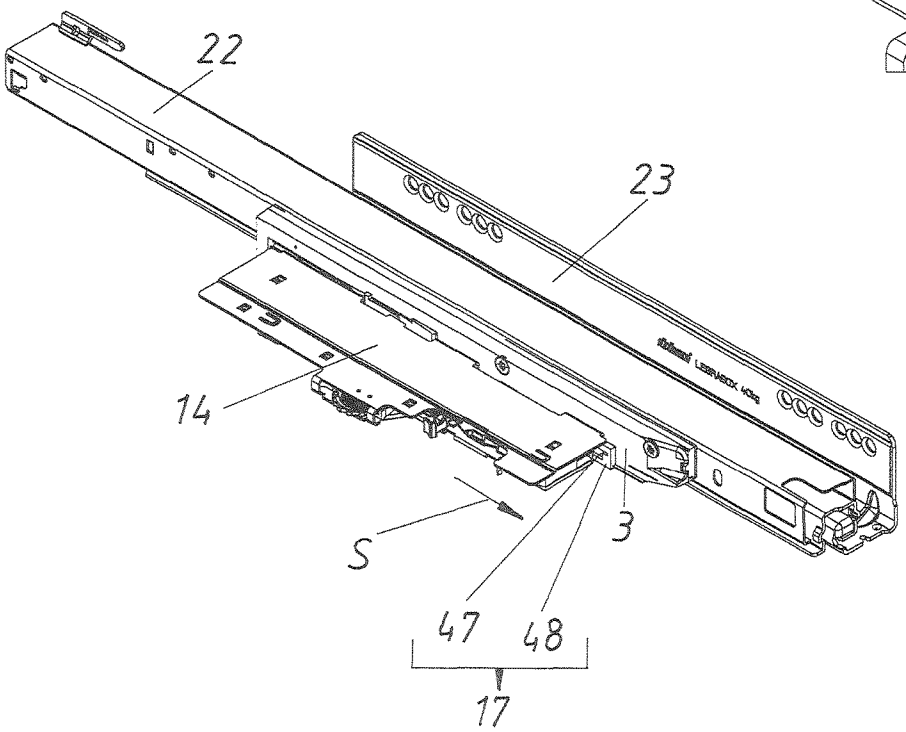

If now the ejecting device 14, as illustrated in FIGS. 9A and 9B, is pressed to the retracting device 3, the latch 12 is pushed in by the triggering element 15 formed on the housing 25. Thereby, the blocking device 13 is not anymore in the blocking position B but in the release position L. The latch 12 does not abut the stop 13 anymore.

Originating from this position according to FIG. 9A or 9B, the ejection device 14 is then fixed to the retracting device 3. This fixation is at least in part effected by the locking catch 47 moving into the locking stop 48. These components 47 and 48 together build a part of the fixing device 17. Simultaneous with this sliding movement S, the slide part 10 is moved with the limit stop 54 formed on the housing, so that the slide part 10 gets from the first state S1 to the second state S2. During this slide movement S, the blocking device 11 also remains in its releasing position L (see FIG. 10B).

Figure 11:
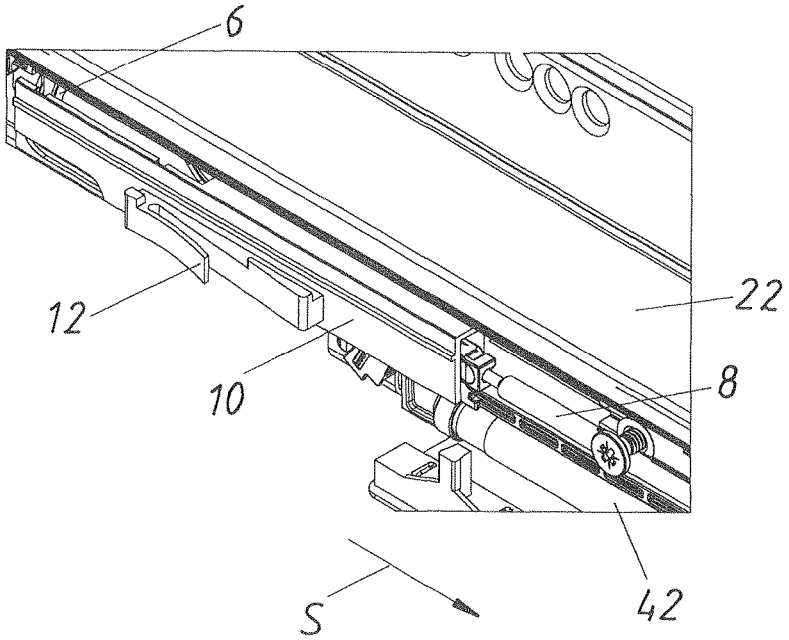
FIGS. 11 and 12 show details of the retracting device when changing the state of the slide part.
Figure 12:
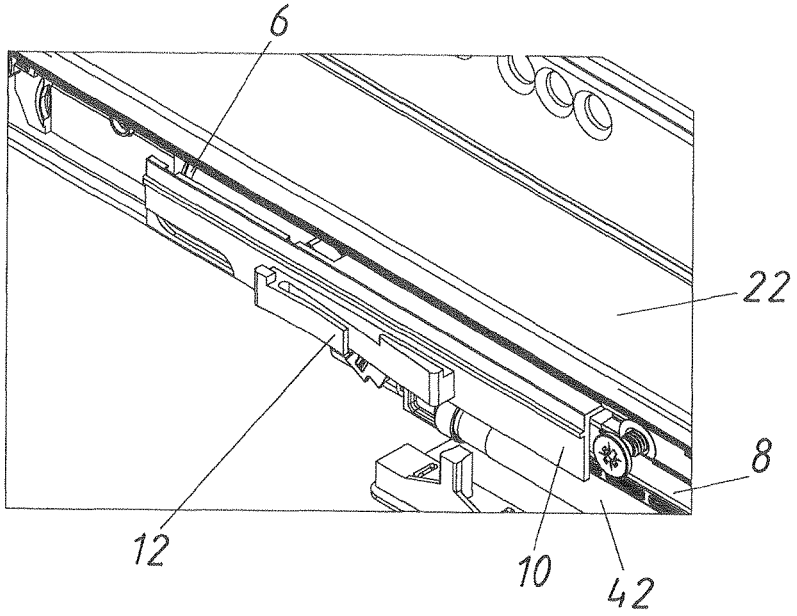

For a better illustration, the ejection device 14 and the base cover 38 of the base part 9 are hidden in FIGS. 11 and 12, whereby a better view onto the slide part 10 and onto its position relative to the base plate 37 of the base part 9 is possible. In FIG. 11, the slide part 10 is still in its first state S1. Also the latch 12 is still not pushed in. In contrast, the latch 12 is pushed in in FIG. 12 and the slide part 10 is already slid. Thereby, also the retaining section 6 of the guide path 5 closer to the retracting force storage means 8.

Figure 13:
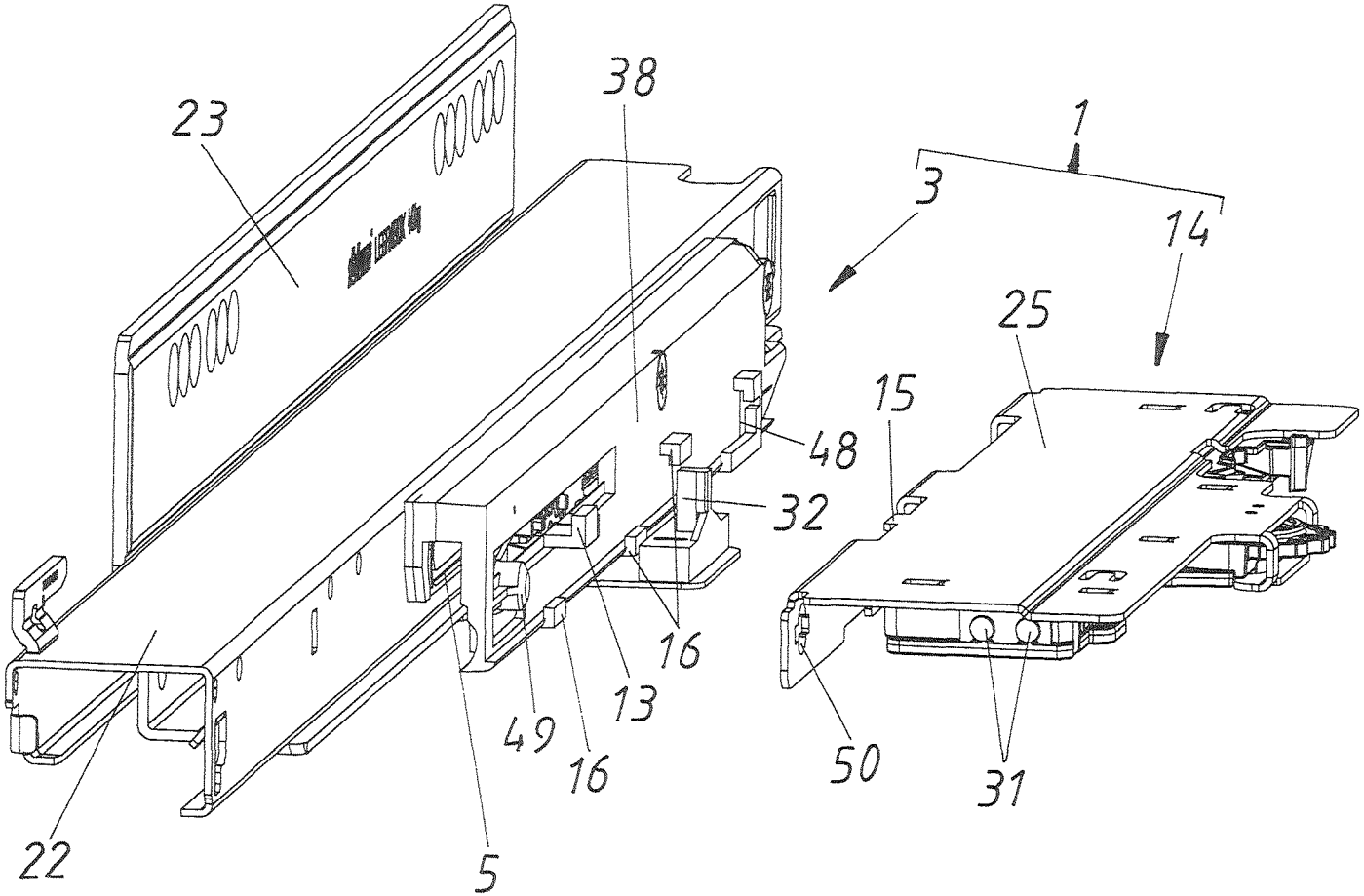
FIGS. 13 to 15 show details for the connection of the ejection device with the retracting device.
Figure 14:
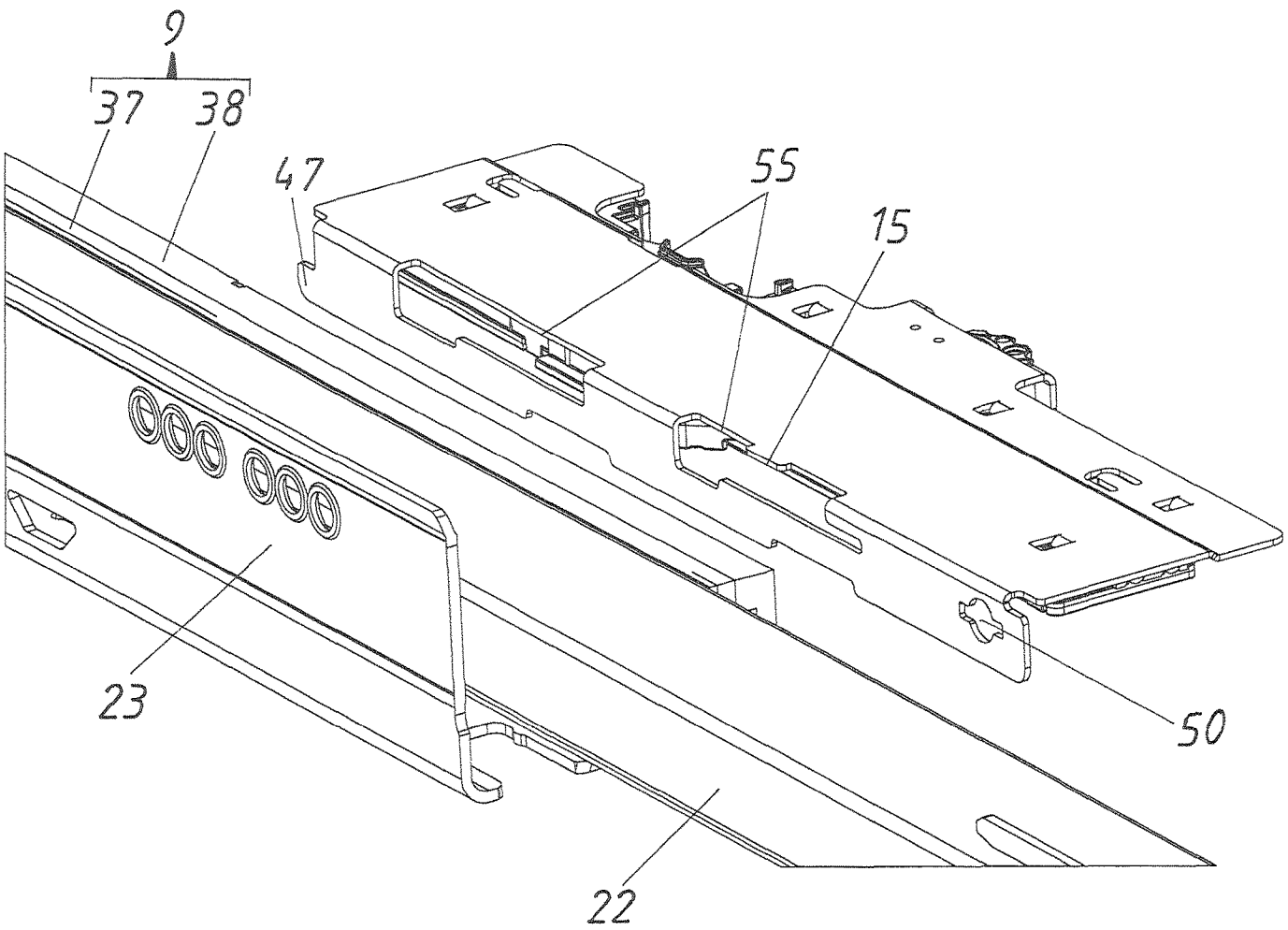
Figure 15:
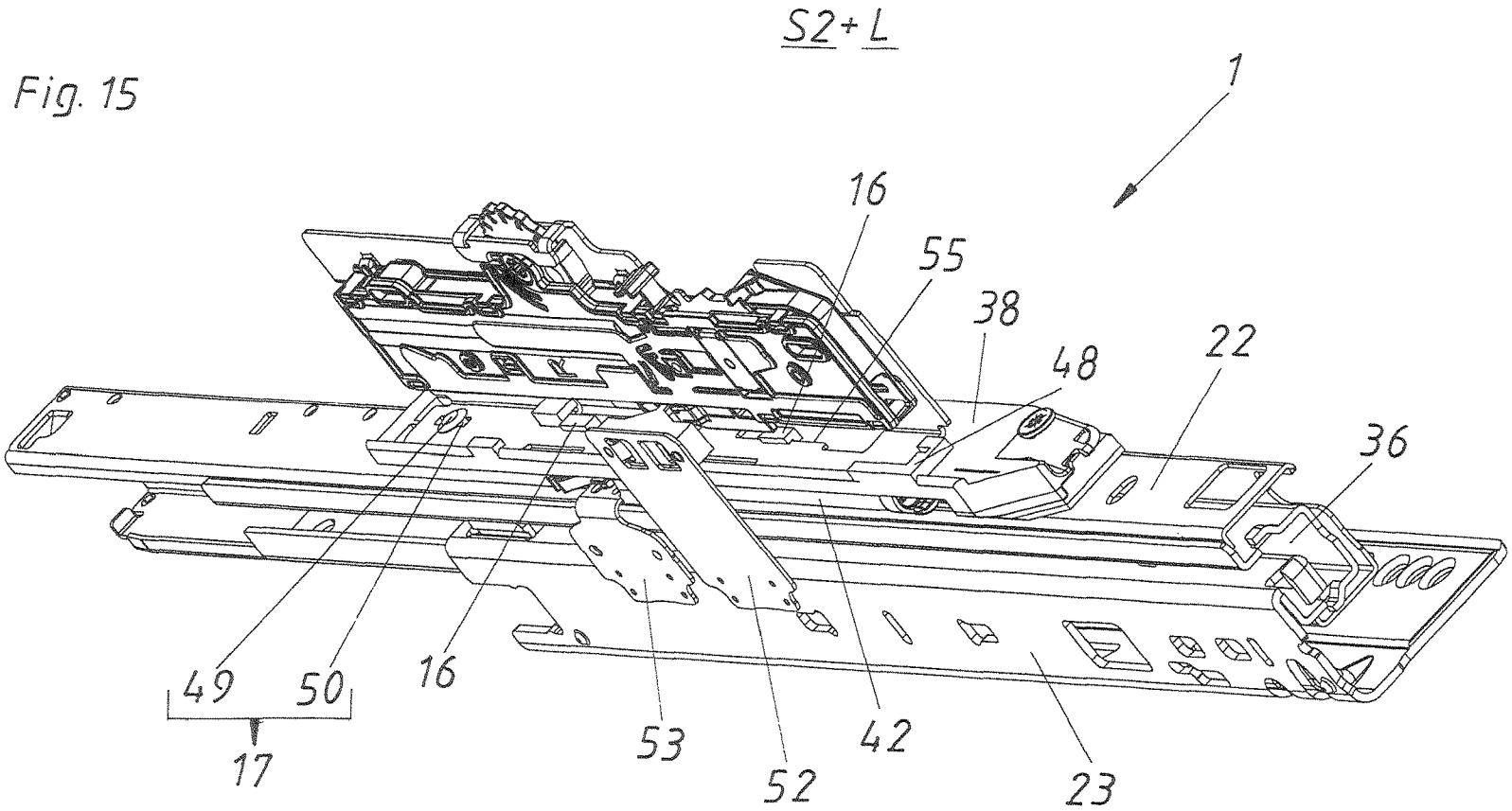

The retracting device 3 mounted to the drawer rail 22 and the not-yet-mounted ejection device 14 are shown in FIG. 13. The guiding elements 16 as well as the locking stop 48 and the locking projection 19, which are all together formed on the base cover 38, are well visible in this FIG. 13. Corresponding to these components of the retracting device 3—as can be seen in FIG. 14—the locking recess 50, the triggering element 15, the guiding recesses 55, and the locking catch 47 are formed on the ejection device 14 or on its housing 25 and fixation plate, respectively. With the sliding movement S already described, the fixation of the ejection device 14 to the retracting device 3 is then carried out. Thereby, the position according to FIG. 15 is reached, in which the locking catch 47 is fixed at the locking stop 48 and the locking projection 49 is fixed in the locking recess 50.

In FIGS. 16 to 19 the basic objects of the invention are again illustrated. According to FIG. 16, the movable furniture part 2 is in an open position OS, wherein the retracting entrainment member 33 already contacts the catch lever 40 of the retracting slide 7. This retracting slide 7, however, is still in the first end position E1 which corresponds to the retaining section 6 of the guide path 5. The slide part 10 is in its first state S1. From this position according to FIG. 16, the first retracting path EW1 starts and ends in the closed position SS according to FIG. 17, in which the retracting slide 7 is in its second end position E2. The retracting slide 7 could, of course, be moved further in closing direction. Basically, this second end position E2, however, corresponds to the position where the movable furniture part 2 is located in the closed position SS.

Figures 16, 17, 18, 19:
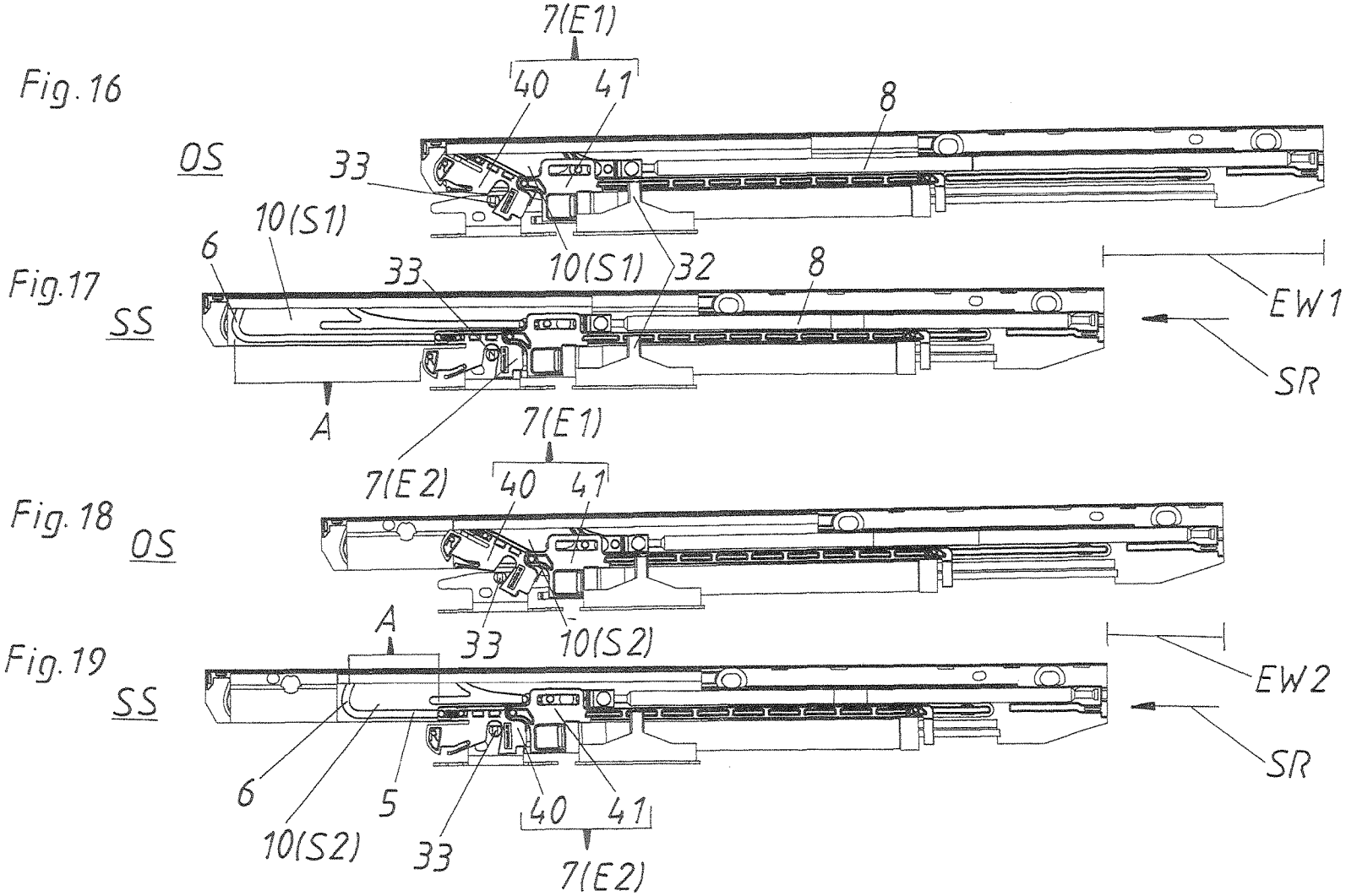
FIGS. 16 to 19 show comparisons of the retracting path at different states of the slide part.

In FIG. 18, the position of the slide part 10 relative to the drawer rail 22 was changed. Therefore, the slide part 10 is in the second state S2. Although the drawer rail 22 has already been moved further in closing direction SR compared with FIG. 16, the retracting entrainment member 33 is still at the beginning of the releasing movement of the catch lever 40 from the retaining section 6. Thus, the retracting slide 7 is still in the first end position E1. Originating from this position, the shortened retracting path EW2 starts, in which the retracting force storage member 8 relaxes and the movable furniture part 2 moves in closing direction SR into the closed position SS according to FIG. 19. Thereby the retracting slide 7 is again in its second end position E2. In a comparison of FIGS. 19 and 17, it can thus be seen how according to the invention the distance A of the end positions E1 and E2 can be changed from each other along the guide path 5.

The invention claimed is:

1. A drive device for moving a movable furniture part, said drive device comprising:

a retracting device configured to move between an open position and a closed position, the retracting device to be connected to the movable furniture part so as to retract the movable furniture part from the open position into the closed position, said retracting device including:

a housing, a guide path which is formed in the housing and which comprises a retaining section, a retracting slide movable in the guide path relative to the housing and lockable in the retaining section, and a retracting force storage member which urges the retracting slide, wherein the retracting slide is movable along the guide path between a first end position, which is at the retaining section, and a second end position, which is at the closed position, and wherein the housing has a base part and a slide part movable relative to the base part between at least a first state and a second state so as to adjust a distance between the first end position and the second end position along the guide path.

2. The drive device according to claim 1, wherein the distance between the first end position and the second end position of the retracting slide along the guide path is larger in the first state than in the second state.

3. The drive device according to claim 1, wherein the guide path is formed in the slide part.

4. The drive device according to claim 1, wherein the slide part is configured to be set in a blocking position by a blocking device, the blocking position corresponding to the first state.

5. The drive device according to claim 4, wherein the blocking device is configured to unset the blocking position of the blocking device, whereby the slide part is movable from the first state into the second state.

6. The drive device according to claim 4, wherein the blocking device comprises a movable latch formed on the slide part, and a stop for the latch, the stop being formed on the base part.

7. The drive device according to claim 6, wherein the latch comprises an elastically movable latch.

8. The drive device according to claim 1, further comprising an ejection device for ejecting the movable furniture part out of the closed position into an open position.

9. The drive device according to claim 8, wherein the ejection device is connectable with the retracting device, wherein the distance between the first end position and the second end position along the guide path is adjustable by connecting the ejection device with the retracting device.

10. The drive device according to claim 8, wherein the blocking device is configured to unset the blocking position of the blocking device by the ejection device.

11. The drive device according to claim 8, wherein the ejection device comprises a triggering element configured to move the blocking device from the blocking position, in which the latch abuts the stop, into a release position, in which the latch is released from the stop by the triggering element, when connecting the ejection device with the retracting device.

12. The drive device according to claim 8, wherein the ejection device is fixed to the retracting device by a fixing device.

13. The drive device according to claim 12, wherein the retracting device has guiding elements for guiding the ejection device, wherein the ejection device is configured to be fixed at the retracting device by the fixing device by a sliding movement guided by the guiding element.

14. The drive device according to claim 13, wherein the slide part of the retracting device is movable from the first state to the second state during the slide movement of the ejection device.

15. The drive device according to claim 12, wherein the ejection device is positive-locked to the retracting device by the fixing device so as to be fixed.

16. An article of furniture comprising the drive device according to claim 1.

* * * * *